US008925323B2

(12) United States Patent
Zuo

(10) Patent No.: US 8,925,323 B2
(45) Date of Patent: Jan. 6, 2015

(54) FUEL/AIR PREMIXING SYSTEM FOR TURBINE ENGINE

(75) Inventor: Baifang Zuo, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 112 days.

(21) Appl. No.: 13/460,700

(22) Filed: Apr. 30, 2012

(65) Prior Publication Data

US 2013/0283805 A1 Oct. 31, 2013

(51) Int. Cl.
*F02G 3/00* (2006.01)
*F02C 1/00* (2006.01)

(52) U.S. Cl.
USPC ..... 60/737; 60/742; 60/748

(58) Field of Classification Search
USPC ..... 60/737, 742, 748; 415/191, 211.2; 416/231 A, 237, 191, 211.2
See application file for complete search history.

(56) References Cited

U.S. PATENT DOCUMENTS

| | | | | |
|---|---|---|---|---|
| 5,349,812 | A * | 9/1994 | Taniguchi et al. | 60/39.23 |
| 6,438,961 | B2 * | 8/2002 | Tuthill et al. | 60/776 |
| 2008/0148736 | A1 * | 6/2008 | Ishizaka et al. | 60/737 |
| 2009/0183511 | A1 | 7/2009 | Dinu | |
| 2010/0326079 | A1 * | 12/2010 | Zuo et al. | 60/748 |

FOREIGN PATENT DOCUMENTS

| | | | |
|---|---|---|---|
| EP | 0376259 | A2 | 7/1990 |
| EP | 0445938 | A1 | 9/1991 |
| EP | 0548908 | A2 | 6/1993 |
| EP | 0636835 | A3 | 2/1995 |
| EP | 0644374 | A2 | 3/1995 |
| EP | 0644375 | A3 | 3/1995 |
| EP | 0654639 | A1 | 5/1995 |
| EP | 0672865 | A3 | 9/1995 |
| EP | 0690264 | A3 | 1/1996 |
| EP | 0691512 | A3 | 1/1996 |
| EP | 0731316 | A1 | 9/1996 |
| EP | 0738854 | A3 | 10/1996 |
| EP | 0747635 | A2 | 12/1996 |
| EP | 0747636 | A2 | 12/1996 |
| EP | 0751345 | A1 | 1/1997 |
| EP | 0809068 | A2 | 11/1997 |
| EP | 1764555 | A2 | 3/2007 |
| EP | 1830129 | A2 | 9/2007 |
| EP | 1923637 | A2 | 5/2008 |
| EP | 1944546 | A2 | 7/2008 |

* cited by examiner

*Primary Examiner* — Phutthiwat Wongwian
*Assistant Examiner* — William Breazeal
(74) *Attorney, Agent, or Firm* — Fletcher Yoder, P.C.

(57) ABSTRACT

A system includes a fuel nozzle. The fuel nozzle includes a center body configured to receive a first portion of air and to deliver the air to a combustion region. The fuel nozzle also includes a swirler configured to receive a second portion of air and to deliver the air to the combustion region. The swirler includes an outer shroud wall, an inner hub wall, and a swirl vane. The swirl vane includes a radial swirl profile at a downstream edge of the swirl vane. The radial swirl profile includes a region extending from the outer shroud wall to a first transition point and a second region extending from the transition point to the inner hub wall. At least one of the first and second regions is substantially straight and at least one of the first and second regions is arcuate.

19 Claims, 8 Drawing Sheets

FUEL/AIR PREMIXING SYSTEM FOR TURBINE ENGINE

BACKGROUND OF THE INVENTION

The subject matter disclosed herein relates to a turbine engine and, more specifically, to a system to improve the operability of a fuel nozzle.

A gas turbine engine combusts a mixture of fuel and air to generate hot combustion gases, which in turn drive one or more turbine stages. In particular, the hot combustion gases force turbine blades to rotate, thereby driving a shaft to rotate one or more loads, such as an electrical generator. The gas turbine engine includes a fuel nozzle to direct fuel and air into a combustion zone. A flame develops in a combustion zone having a combustible mixture of fuel and air. Unfortunately, the flame can potentially propagate upstream from the combustion zone into the fuel nozzle, which can impact performance of the fuel nozzle due to the heat of combustion. This phenomenon is generally referred to as flashback. Likewise, the flame can sometimes develop on or near the fuel nozzle surfaces. This phenomenon is generally referred to as flame holding. For example, the flame holding may occur on or near a fuel nozzle in a low velocity region.

BRIEF DESCRIPTION OF THE INVENTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In accordance with a first embodiment, a system includes a fuel nozzle. The fuel nozzle includes a center body configured to receive a first portion of air and to deliver the air to a combustion region. The fuel nozzle also includes a swirler configured to receive a second portion of air and to deliver the air to the combustion region. The swirler includes an outer shroud wall, an inner hub wall, and a swirl vane. The swirl vane includes a radial swirl profile at a downstream edge of the swirl vane. The radial swirl profile includes a region extending from the outer shroud wall to a transition point and a second region extending from the transition point to the inner hub wall. At least one of the first and second regions is substantially straight and at least one of the first and second regions is arcuate.

In accordance with a second embodiment, a method includes directing a first portion of air through a center body of a fuel nozzle. The first portion of air exits the center body with a first swirl angle near a hub wall of the fuel nozzle. The method also includes directing a second portion of air through a swirler of the fuel nozzle. The second portion of air exits the swirler with a second swirl angle near a shroud wall of the fuel nozzle. The second portion of air exits the swirler with a third swirl angle near the hub wall of the fuel nozzle. The second swirl angle is greater than the third swirl angle.

In accordance with a third embodiment, a system includes a fuel nozzle swirler. The fuel nozzle swirler includes an outer shroud wall, an inner hub wall, and a swirl vane. The swirl vane includes a radial swirl profile at a downstream edge of the swirl vane. The radial swirl profile includes a first region extending from the outer shroud wall to a transition point and a second region extending from the transition point to the inner hub wall. The first region is substantially constant, and the second region is substantially decreasing toward the hub wall.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

The present disclosure is directed to fuel/air premixing systems that can be employed to increase the mixing of a fuel and air mixture before the mixture enters a combustion zone. According to certain embodiments, the premixing systems include a swirler with swirl vanes that have a constant turn and forced vortex radial profile. The swirler may maintain a high swirl angle near the shroud wall to enhance mixing and flame stabilization. The swirler may also maintain a reduced swirl and higher axial velocity near the hub wall to lessen the likelihood or impact of flame flashback or flame holding. Additionally, a swirl purge air may be introduced to further stabilize the flame downstream of the center body. The ratio of air flowing through the swirler relative to air flowing through the center body may be modulated to enable the system to operate at decreased flow rates (e.g. turndown).

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

Figure 1:
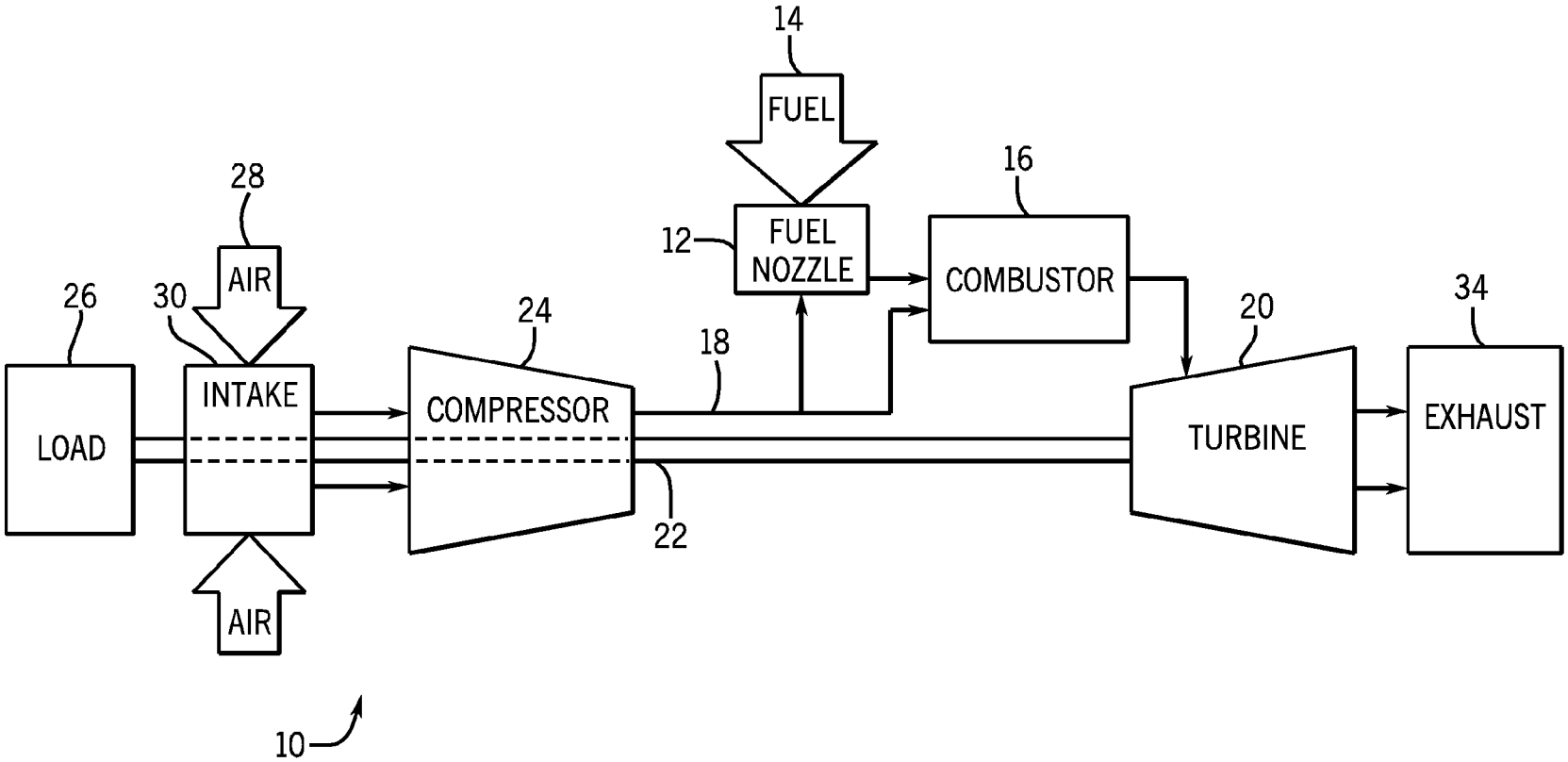
FIG. 1 is a block diagram of an embodiment of a gas turbine system in accordance with aspects of the present techniques.

Turning now to the drawings and referring first to FIG. 1, a block diagram of an embodiment of a gas turbine system 10 (e.g. gas turbine engine) is illustrated. The diagram includes a fuel nozzle 12, a fuel supply 14, and a combustor 16. As depicted, the fuel supply 14 includes a liquid fuel or gas fuel, such as natural gas, which is routed to the gas turbine system 10 through the fuel nozzle 12 into the combustor 16. After the fuel mixes with pressurized air, shown by arrow 18, ignition occurs in the combustor 16. The fuel nozzle 12 may include systems for enhancing the mixing of the fuel and air before the mixture is ignited. More specifically, as described in greater detail below, the fuel nozzle 12 may include a swirler designed to enhance fuel and air mixing, stabilize the flame, reduce flame flashback or flame holding, and enable the gas turbine system 10 to operate at turndown rates. From the combustor 16, the exhaust gas resulting from ignition causes blades within a turbine 20 to rotate. The coupling between blades in turbine 20 and a shaft 22 will cause rotation of the shaft 22, which is also coupled to several components throughout the gas turbine system 10, as illustrated. For example, the illustrated shaft 22 is drivingly coupled to a compressor 24 and a load 26. As appreciated, the load 26 may be any suitable device that may generate power via the rotational output of the gas turbine system 10, such as a generator or a vehicle.

An air supply 28 enters an air intake 30, which then routes the air into the compressor 24. The compressor 24 includes multiple blades drivingly coupled to the shaft 22, thereby compressing air from the air intake 30 and routing it to the fuel nozzles 12 and the combustor 16, as indicated by arrows 18. The fuel nozzles 12 may then mix the pressurized air and fuel at an optimal ratio for combustion, e.g., a combustion that causes the fuel to more completely burn so as not to waste fuel or cause excess emissions. After passing through the turbine 20, the hot exhaust gases exit the gas turbine system 10 at an exhaust outlet 34. The gas turbine system 10 includes a variety of components that move and/or rotate, such as the shaft 22, relative to other components that are stationary during operation of the gas turbine system 10.

Figure 2:
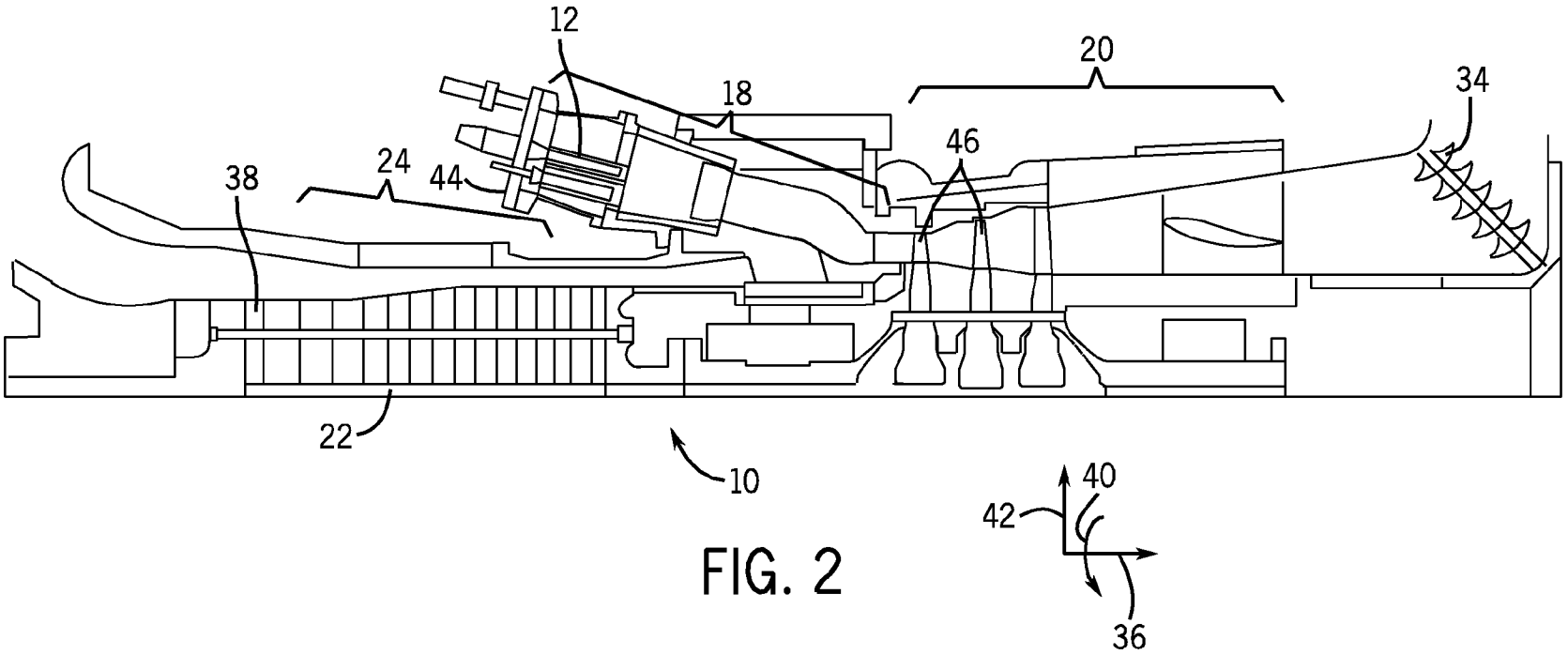
FIG. 2 is a cross-sectional side view of an embodiment of the gas turbine engine of FIG. 1 taken along the longitudinal axis in accordance with aspects of the present techniques.

FIG. 2 is a cross-sectional side view taken along an axial direction 36 of an embodiment of the gas turbine system 10 as illustrated in FIG. 1. In operation, air enters the gas turbine system 10 through the air intake 30 and into the compressor 24. The compressor 24 includes multiple blades 38 that rotate in a circumferential direction 40 around the shaft 22 to pressurize the air. The blades 38 route the air into the fuel nozzles 12 within the combustor 16. The combustor 16 is disposed in a radial direction 42 outward from the compressor 24. The combustor 16 may include a head end 44 to which the fuel nozzles 12 are mounted. The compressed air premixes with fuel within the fuel nozzles 12 and the mixture ignites within the combustor 16. The combustion generates hot exhaust gases, which are routed to the turbine 20. Within the turbine 20, the exhaust gases drive blades 46 and then flow to the exhaust outlet 34. It should be noted that the gas turbine system 10 may work with suitable working fluids other than air, such as blends of carbon dioxide and oxygen.

Figure 3:
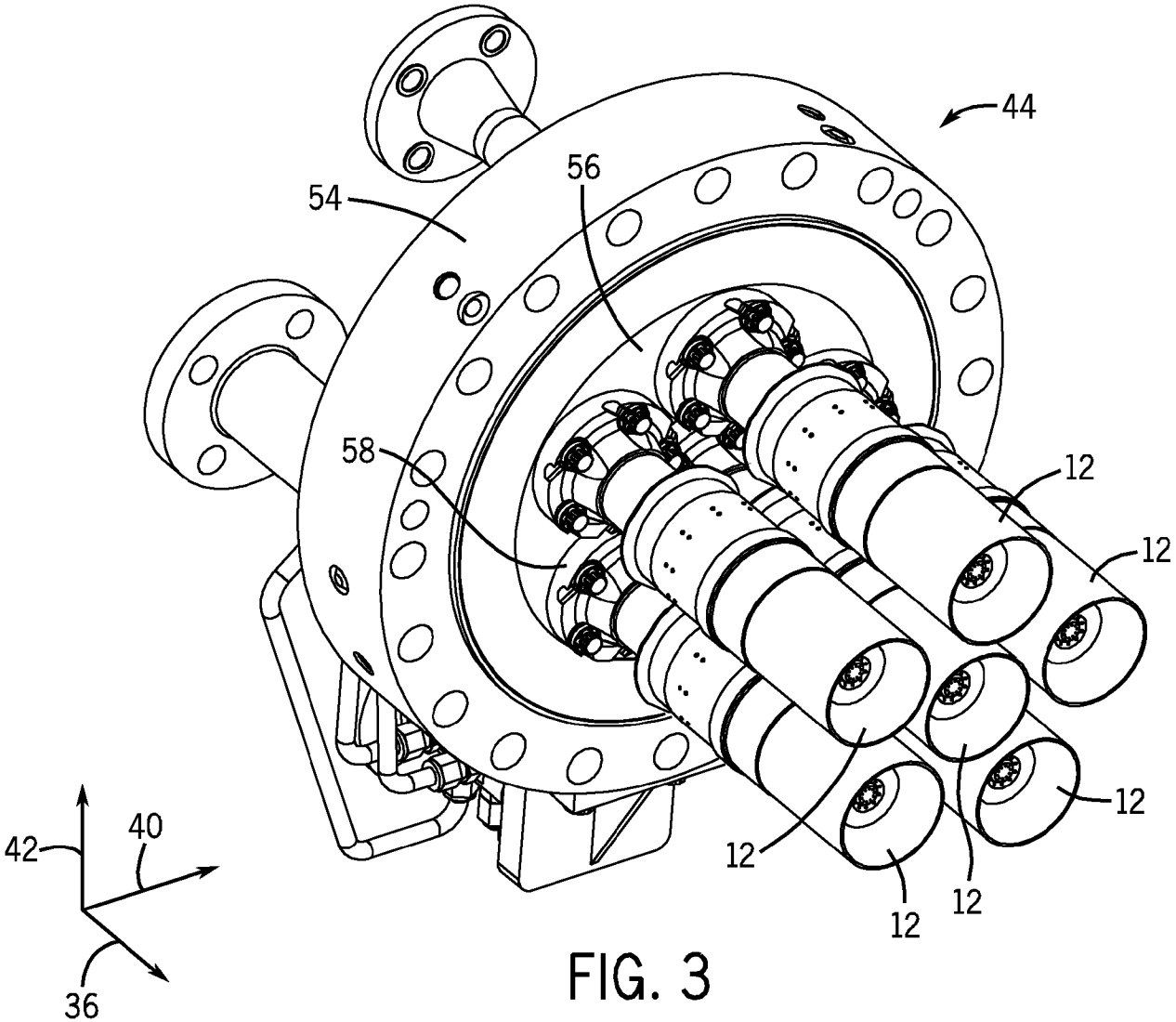
FIG. 3 is a perspective view of an embodiment of a combustor head end having an end cover with multiple fuel nozzles in accordance with aspects of the present techniques.

FIG. 3 is a perspective view of an embodiment of the combustor head end 44 having an end cover 54 with multiple fuel nozzles 12 attached to an end cover base surface 56 via sealing joints 58. As illustrated, the combustor head end 44 has six fuel nozzles 12. In certain embodiments, the number of fuel nozzles 12 may vary (e.g., approximately 1 to 100 fuel nozzles 12). The head end 44 routes the compressed air from the compressor 24 and the fuel through the end cover 54 to each of the fuel nozzles 12, which at least partially pre-mix the compressed air and fuel as an air-fuel mixture prior to entry into a combustion zone in the combustor 16. As discussed in greater detail below, the fuel nozzles 12 may include one or more swirl vanes that may induce swirl in an air flow path (e.g. velocity in circumferential direction 40), wherein each swirl vane includes fuel injection ports to inject fuel into the air flow path.

Figure 4:
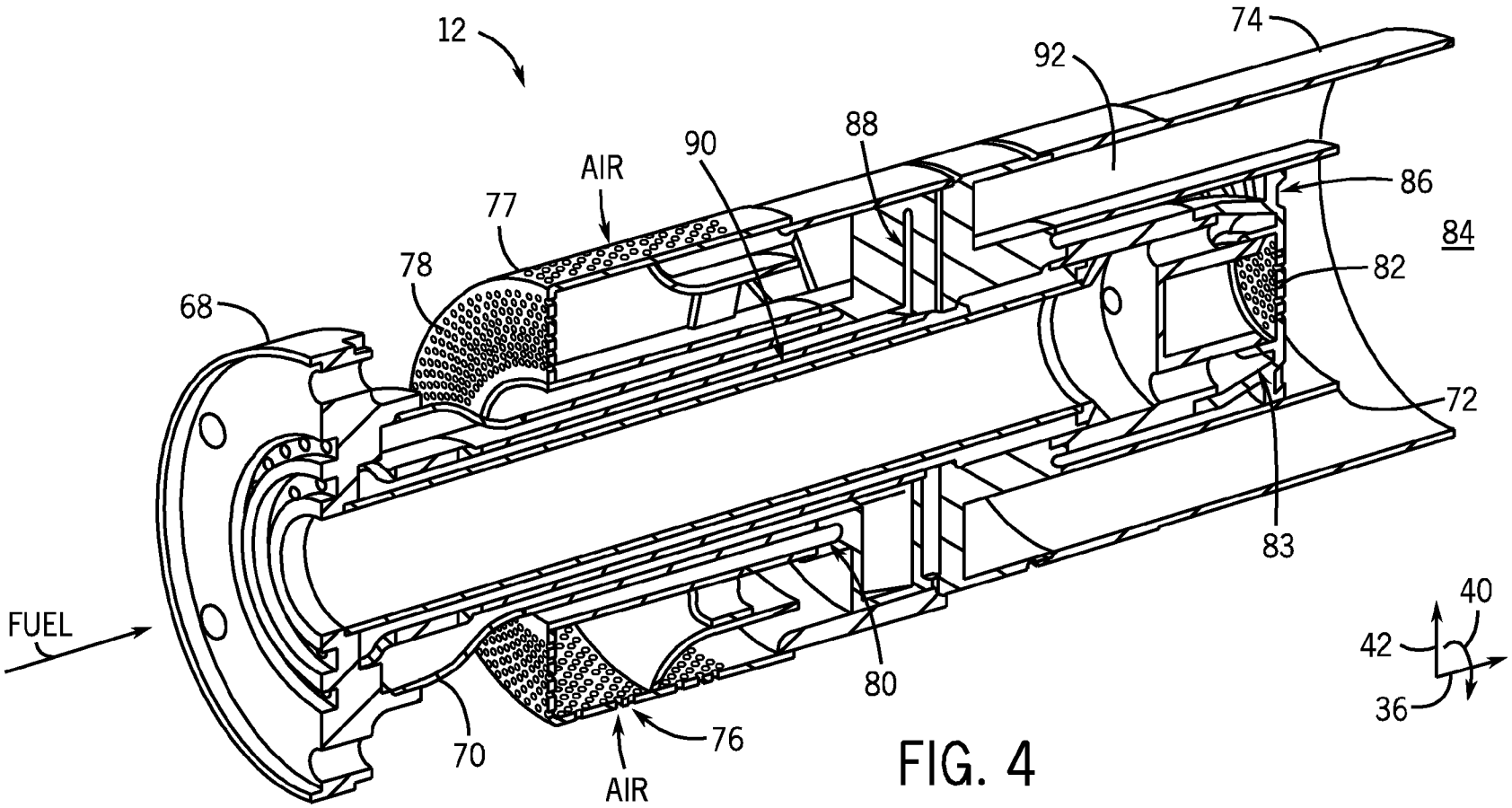
FIG. 4 is a perspective cross-sectional view of an embodiment of a fuel nozzle of FIG. 3 that may employ a swirler to premix fuel and air in accordance with aspects of the present techniques.

FIG. 4 is a perspective cross-sectional view of an embodiment of a fuel nozzle 12 that includes one or more swirl vanes that may induce swirl in an air flow path and inject fuel into the air flow path. The fuel nozzle 12 is coupled to the combustor 16 by a mounting flange 68. The fuel nozzle 12 includes a fuel conduit 70 that is enclosed by a hub wall 72. The fuel conduit 70 is disposed centrally within the fuel nozzle 12. The fuel conduit 70 is generally cylindrical in shape. The hub wall 72 encloses a series of passages that route air and/or fuel to various internal components of the fuel nozzle 12. A shroud wall 74 encloses the hub wall 72 and includes additional passages to route air and/or fuel through the fuel nozzle 12. The shroud wall 74 and the hub wall 72 have similar geometry and, as shown, may both be generally cylindrical in shape. An inlet flow conditioner 76 is coupled to the shroud wall 74 and is disposed about the hub wall 72. The inlet flow conditioner 76 includes a first perforated sheet 77 that extends in the axial direction 36 and a second perforated sheet 78 that extends in the radial direction 42. According to certain embodiments, the perforated sheets 77, 78 may be integrally formed using one-piece construction. The perforated sheets 77, 78 may be designed to meter and diffuse the air entering the fuel nozzle 12.

Air enters the fuel nozzle 12 through inlet flow conditioner 76. A portion of the air (e.g. diffusion air) may flow along a diffusion air passage 80 in the axial direction 36. The diffusion air flows towards a center body 82 and may be directed radially into the center body 82 through diffusion gas ports 83. Within the center body 82, the diffusion air may mix with fuel from the fuel conduit 70. The mixture may exit the center body 82 and flow into a combustion region 84 downstream of the fuel nozzle 12. According to certain embodiments, the mixture of fuel and diffusion air may have a relatively high velocity in the axial direction 36 to reduce the likelihood or impact of flame flashback or flame holding near the hub wall 74. A portion of the diffusion air (e.g. swirl purge air) may flow through the diffusion air passage 80 to a diffusion swirler 86, which may be part of the center body 82 and may be disposed near a downstream end of the center body 82. In certain embodiments, the diffusion swirler 86 may contain a plurality of swirler vanes disposed in an annual pattern, as partially shown in FIG. 4. The diffusion swirler 86 may impart a swirl to the swirl purge air in a clockwise or counterclockwise direction in the circumferential direction 40. The swirl angle imparted to the purge air may be at an angle between approximately 10 to 80, approximately 20 to 70, or approximately 30 to 50 degrees. According to certain embodiments, the swirl purge air may help to stabilize the flame downstream of the center body 82, reduce the likelihood of flow separation from the center body 82, and improve dynamics.

A second portion of the air entering the inlet flow conditioner 76 (e.g. main combustion air) may flow to a swirler 88, which may include a plurality of swirl vanes as described in greater detail below. The swirler 88 may impart a swirling motion to the main combustion air in a clockwise or counter-clockwise direction in the circumferential direction 40. In certain embodiments, the swirler 88 may induce a swirl in an opposite direction to the swirl induced by the diffusion swirler 86 in the center body 82. For example, the swirler 88 may induce a clockwise swirl and the diffusion swirler 86 may induce a counter-clockwise swirl. In other embodiments, the swirlers 86, 88 may induce a swirl in the same direction. For example, the swirler 88 may induce a higher swirl velocity to a portion of air proximate to the shroud wall 74 and a lower swirl velocity to another portion of air proximate to the hub wall 72. The diffusion swirler 86 may induce a higher swirl velocity proximate to the hub wall 72 to compensate for the lower swirl velocity of the swirler 88. The increased axial velocity proximate to the hub wall 72 may reduce the likelihood of flame holding or flame flashback, and the enhanced swirl velocity induced by the diffusion swirler 86 may help to stabilize the flame.

A portion of the fuel in the fuel conduit 70 (e.g. premix fuel) may flow in the axial direction 36 through premix fuel passages 90 to the swirler 88. The premix fuel flows radially through the swirler 88 through fuel injection ports, as described in greater detail below. The premix fuel and main combustion air mix within the swirler 88. The mixture is directed through a premix annulus 92 to the combustion region 84. According to certain embodiments, the swirler 88 may impart a high swirl angle to the main combustion air and fuel near the shroud wall 74. The high swirl angle may enhance mixing and flame stabilization at the shroud wall 74.

The percentage of main combustion air flowing through the swirler 88 relative to the total air entering the inlet flow conditioner 76 may vary. In certain embodiments, the percentage may range from approximately 50% to approximately 99%, or more specifically from approximately 70% to approximately 95%, or even more specifically from approximately 80% to approximately 95%. The remaining air (diffusion air) flows through the center body 82. Thus, the main combustion air flow may be greater than the diffusion air flow, and the ratio of main combustion air to diffusion air may vary. Corresponding to the aforementioned percentages, the ratio may range from approximately 0.01 to approximately 1, or more specifically from approximately 0.05 to approximately 0.43, or even more specifically from approximately 0.05 to approximately 0.25. Additionally, the ratio of air to fuel at the premix annulus 92 may be different from the ratio of air to fuel at the center body 82. For example, the mixture at the premix annulus 92 may have a higher air to fuel ratio, and the mixture at the center body 82 may have a lower air to fuel ratio. Further, these ratios may be different depending on the mode of operation. For example, during turndown operation, a higher fuel to air ratio may be desired at the center body 82 compared to during normal operation.

Figure 5:
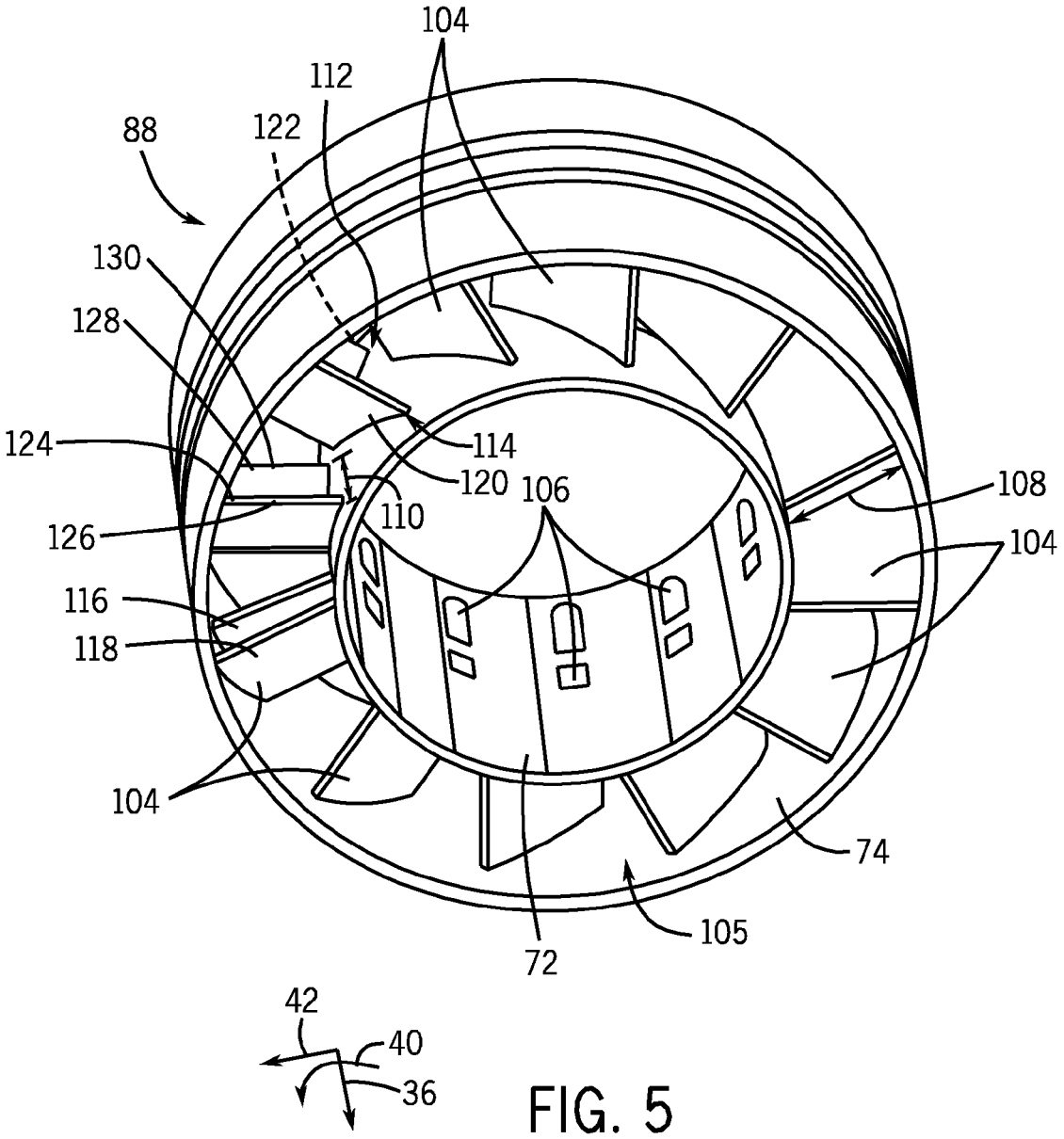
FIG. 5 is a perspective view of an embodiment of a swirler that may employ swirl vanes in accordance with aspects of the present techniques.

FIG. 5 is a perspective view of an embodiment of the swirler 88 including multiple swirl vanes 104 designed to enhance fuel/air mixing and improve flame stabilization. Air flows through an annular space 105 between the shroud wall 74 and the hub wall 72, where the air encounters the swirl vanes 104. The swirl vanes 104 may induce a swirling motion in the air in a clockwise or counterclockwise direction in the circumferential direction 40. The swirl vanes 104 are disposed radially between the shroud wall 74 and the hub wall 72. As shown, the swirler 88 includes twelve swirl vanes 104. In certain embodiments, the number of swirl vanes 104 may vary. The swirler 88 includes multiple fuel injection ports 106 in the hub wall 72. The fuel injection ports 106 may direct fuel radially into fuel plenums of the swirler 88 (e.g., from the premix fuel passages 90 described above). The fuel may be directed through fuel holes located on the swirl vanes 104 into the annular space 105 where the fuel contacts and mixes with the air. The swirl vanes 104 may induce a swirling motion to the fuel/air mixture.

The swirl vanes 104 have a radius 108 that extends between the shroud wall 74 and the hub wall 72. The swirl vanes 104 also have a length 110 that extends from an upstream flow end 112 to a downstream flow end 114 of the swirl vane 104. Air generally flows from the upstream flow end 112 to the downstream flow end 114. The fuel injection ports 106 may direct fuel through holes on the swirl vanes 104 into the airflow between the upstream flow end 112 and the downstream flow end 114. The swirl vanes 104 include a pressure side 116 and a suction side 118. The pressure side 116 extends from the upstream flow end 112 to the downstream flow end 114, and forms a generally arcuate surface 120. Air generally flows against the pressure side 116, and the air may take a path corresponding to the surface 120. The suction side 118 also extends from the upstream flow end 112 to the downstream flow end 114, and also forms a generally arcuate surface 122. The surface 120 of the pressure side 116 may be different from the surface 122 of the suction side 118. Accordingly, the surfaces 120, 122 may vary along the radius 108 of the swirl vane 104 to form varied air swirl angles downstream of the swirler 88.

The pressure side 116 and the suction side 118 converge at the upstream flow end 112 to form an upstream edge 124. The upstream edge 124 has a radial profile 126, which may be designed to have an approximately zero attack angle with the incoming air flow to minimize flow separations on both the pressure and suction sides 116, 118. The pressure side 116 and the suction side 118 also converge at the downstream flow end 114 to form a downstream edge 128. The downstream edge 128 has a radial swirl profile 130, which may include a combination of substantially straight and arcuate regions. These regions may control the swirl angle of the fuel/air mixture along the downstream edge 128. The radial profile 126 of the upstream edge 124 may vary from the radial profile 130 of the downstream edge 128. The swirler surface shapes of the pressure side 116 and the suction side 118 may vary along the length 110 of the swirl vane 104 to ensure a smooth transition from the upstream edge profile 126 to the downstream edge profile 130 at any radial locations. The radial profile 130 of the downstream edge 128 may be designed to induce a high swirl angle proximate to the shroud wall 74 to enhance mixing of fuel and air. The radial profile 130 may also be designed to induce a low swirl angle proximate to the hub wall 72 to reduce the likelihood or impact of flame flashback or flame holding.

Figure 6:
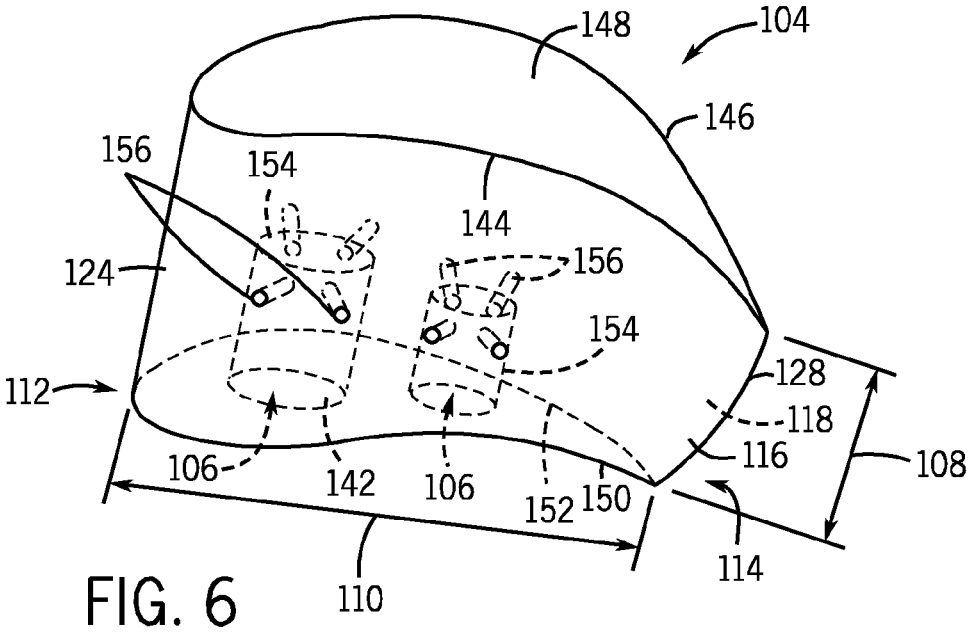
FIG. 6 is a perspective view of an embodiment of a swirl vane as shown in FIG. 5 in accordance with aspects of the present techniques.

FIG. 6 is a perspective view of an embodiment of a swirl vane 104 that may be designed to enhance fuel/air mixing and improve flame stabilization. The swirl vane 104 includes a hub side 142 that is disposed at the hub wall 72. The hub side 142 forms a pressure edge 150 with the pressure side 116 and a suction edge 152 with the suction side 118. The swirl vane 104 also includes a shroud side 148 that is disposed at the shroud wall 74. The shroud side 148 forms a pressure edge 144 with the pressure side 116 and a suction edge 146 with the suction side 118. The shape of the hub side 142 may be different from the shape of the shroud side 148, and the shapes may vary along the radius 108 of the swirl vane 104.

In certain embodiments, the swirl vane 104 includes one or more hollow fuel plenums 154 that extend through hub side 142 into the body of the swirl vane 104. According to certain embodiments, the fuel plenums 154 may be cylindrical, polyhedral, or have another suitable shape. The fuel plenums 154 may receive fuel from the fuel injection ports 106 through the hub wall 72. The swirl vane 104 may also include multiple fuel outlet ports (e.g., fuel injection holes) 156 that direct fuel from the fuel plenums 154 into the annular space 105. Further, in certain embodiments, a subset of the fuel outlet ports 156 may direct fuel towards the pressure side 116, and a second subset of the fuel outlet ports 156 may direct fuel towards the suction side 118. In certain embodiments, the swirl vane 104 may be designed to induce a high axial velocity near the hub wall 72 to reduce the likelihood or impact of flame holding or flashback. Accordingly, in certain embodiments, the fuel outlet ports 156 may be located proximate to the hub wall 72 in order to direct a greater portion of the fuel to the hub wall 72. For example, a distance between the hub wall 72 and the fuel outlet ports 156 may be between approximately 5 to 95, approximately 15 to 85, or approximately 30 to 70 percent of the radius 108.

In certain embodiments, the swirl vane 104 includes multiple fuel injection ports 106 and corresponding fuel plenums 154. Each fuel plenum 154 may have multiple fuel outlet ports (e.g., fuel injection holes) 156 that direct fuel from the fuel plenum 154 into the annular space 105. As illustrated, the fuel outlet ports may be spaced about a circumference of the fuel plenum, such that a portion of the fuel is injected towards the pressure side 116, and a second portion of fuel is injected towards the suction side 118. In certain embodiments, the fuel outlet ports 156 may be located on the vane surface along radial direction 42 and/or on the vane surface along the axial 36 flow direction.

Figure 7:
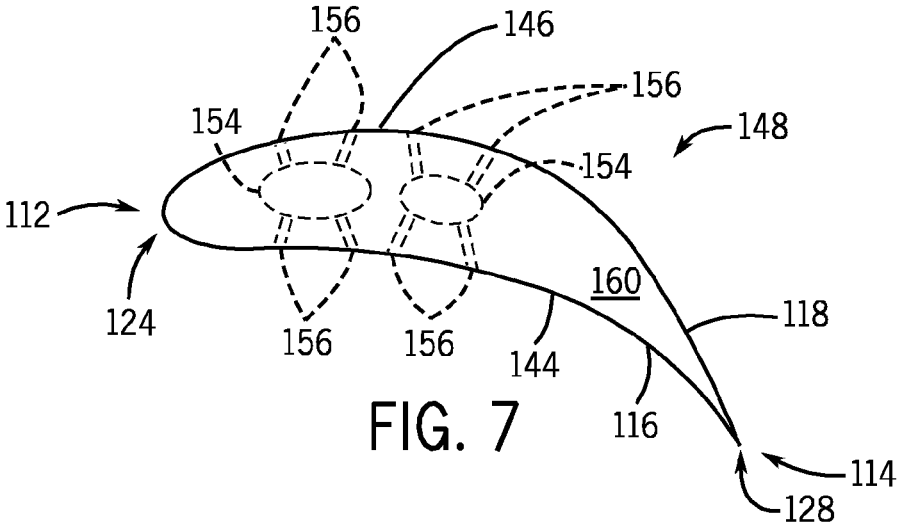
FIG. 7 is a cross-sectional view of an embodiment of the swirl vane of FIG. 6 taken along the longitudinal axis at the shroud wall in accordance with aspects of the present techniques.
Figure 8:
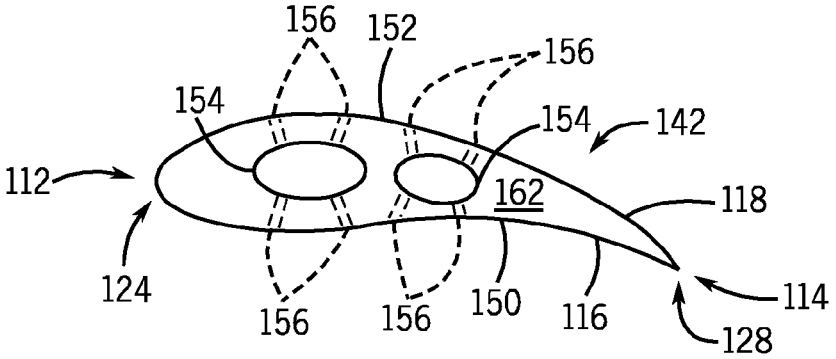
FIG. 8 is a cross-sectional view of an embodiment of the swirl vane of FIG. 6 taken along the longitudinal axis at the hub wall in accordance with aspects of the present techniques.
Figure 9:
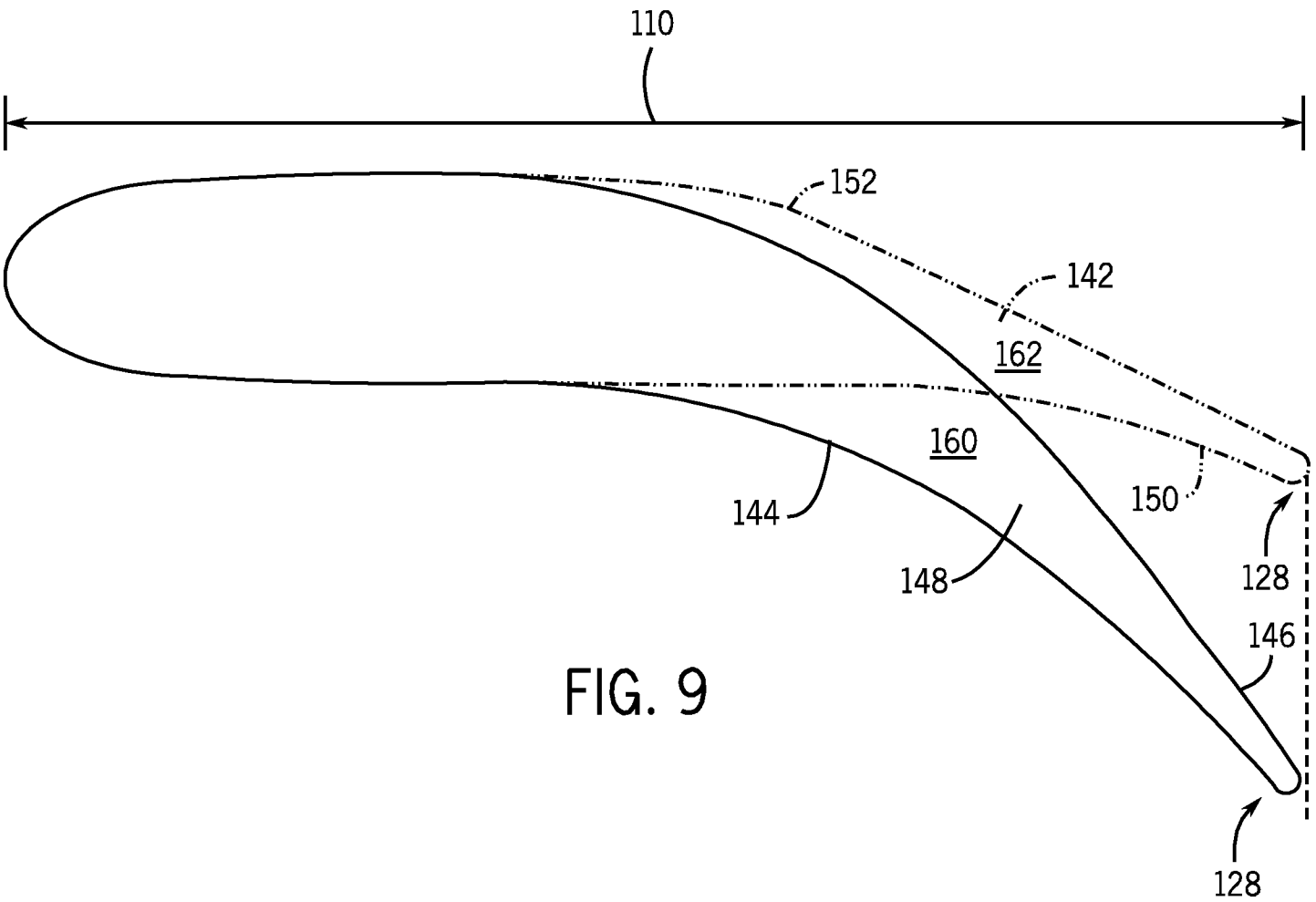
FIG. 9 is a cross-sectional view of a shroud side of the swirl vane of FIG. 7 superimposed on a cross-sectional view of a hub side of the swirl vane of FIG. 8, in accordance with aspects of the present techniques.

FIG. 7 is a cross-sectional view of an embodiment of the shroud side 148 of the swirl vane 104. As illustrated, the fuel plenum 154 and fuel outlet holes 156 may direct fuel to the pressure side 116 and the suction side 118. The shroud side 148 has a generally arcuate shape 160, which extends from the upstream flow end 112 to the downstream flow end 114. The shape 160 may be defined by the suction edge 146, the pressure edge 144, the upstream edge 124, and the downstream edge 128. FIG. 8 is a cross-sectional view of an embodiment of the hub side 142 of the swirl vane 104. The hub side 142 has a generally arcuate shape 162, which extends from the upstream flow end 112 to the downstream flow end 114. The shape 162 may be defined by the suction edge 152, the pressure edge 150, the upstream edge 124 and the downstream edge 128. As shown in FIG. 9, the shape 160 of the shroud side 148 of the swirl vane 104 of FIG. 7 is substantially different from the shape 162 of the hub side 142 of the swirl vane 104 of FIG. 8. The shapes 160, 162 may correspond to the shroud end and the hub end of the radial profile 126 of the upstream end 124 and the radial profile 130 of the downstream end 128. Further, the shape of the swirl vane 104 at any radial cross section may be designed to impart a particular range of swirl angles upon the fuel/air mixture exiting the swirler 88.

FIG. 9 is a cross-sectional view of the shroud side 148 of the swirl vane 104 of FIG. 7 superimposed on a cross-sectional view of a hub side 142 of the swirl vane 104 of FIG. 8. As illustrated, the shapes 160, 162 of the shroud side 148 and the hub side 142 vary along the length 110 of the swirl vane 104. The variation in the shapes 160, 162 may correspond to the radial profiles 126, 130, as discussed above. In particular, the variation in the shapes 160, 162 and corresponding radial profiles 126, 130 may be designed to stabilize the flame downstream of the swirl vanes 104 and improve dynamics.

Figure 10:
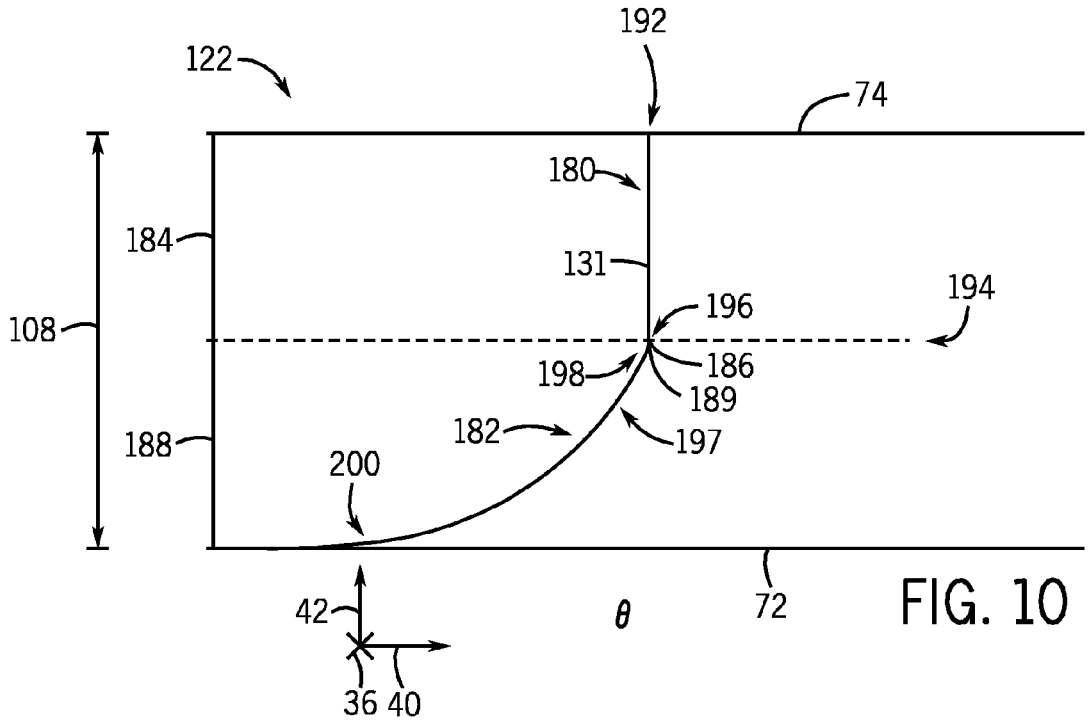
FIG. 10 is a graphical illustration of an embodiment of a radial swirl profile of a downstream edge of a swirl vane in accordance with aspects of the present techniques.

FIG. 10 is a graphical illustration of an embodiment of a radial swirl profile 131 (e.g., swirl angle profile) of the downstream edge 128, showing the swirl angle of the swirl vane 104 from the shroud wall 74 to the hub wall 72. The radial swirl profile 131 is generally arcuate in shape. In certain embodiments, the radial swirl profile 131 may be straight (e.g., constant), arcuate, or include a combination of straight and arcuate shapes. The swirl vane 104 is designed to impart a high-angle swirl proximate to the shroud wall 74 and a reduced swirl angle proximate to the hub wall 72. The high-angle swirl proximate to the shroud wall 74 may enhance fuel/air mixing and improve the flame stabilization margin at the shroud wall 74. The reduced swirl angle proximate to the hub wall 72 may lessen the likelihood or impact of flame flashback from the hub wall 72. In such an embodiment, the radial swirl profile 131 may include a constant turn region 180 that is substantially straight and a forced vortex region 182 that is arcuate. In other embodiments, the radial swirl profile 131 may include multiple regions that may be substantially straight (e.g., constant) or arcuate. For example, the radial swirl profile 131 may include 0, 1, 2, 3, 4, 5, or more substantially straight regions (e.g. constant turn regions) and 0, 1, 2, 3, 4, 5, or more arcuate regions.

The radial swirl profile 131 includes the constant turn region 180 that extends a distance 184 from the shroud wall 74 to a transition point 186. The radial swirl profile 131 also includes the forced vortex region 182 that extends a distance 188 from the transition point 186 to the hub wall 72. In certain embodiments, the swirl vane 104 may include more than one constant turn region 180 and/or more than one forced vortex region 182. In such an embodiment, a separate transition point would be disposed between each region. For example, the swirl vane 104 may include a first constant turn region, a forced vortex region, and a second constant turn region. A first transition point would be disposed between the first constant turn region and the forced vortex region. A second transition point would be disposed between the second constant turn region and the forced vortex region.

As illustrated in FIG. 10, the transition point 186 is disposed between the shroud wall 74 and the hub wall 72. The transition point 186 is located proximate to the center 189 of the downstream edge 128. Accordingly, the distance 184 of the constant turn region 180 is approximately equal to the distance 188 of the forced vortex region 182. In other embodiments, the transition point 186 may be disposed at other locations along the downstream edge 128. For example, the transition point 186 may be located proximate to the shroud wall 74, proximate to the hub wall 72, or at intermediate positions therebetween. Accordingly, the distance 184 of the constant turn region 180 may be larger or smaller than the distance 188 of the forced vortex region 182 depending on the location of the transition point 186. Each of the distances 184, 188 may be approximately 5 to 95, approximately 15 to 85, or approximately 30 to 70 percent of the radius 108.

The constant turn region 180 has a substantially straight shape 190. However, in other embodiments, the shape 190 may have a slight curvature. The constant turn region 180 has a swirl angle 192 at the shroud wall 74. The swirl angle 192 is generally acute. In certain embodiments, the swirl angle 192 near the shroud wall (e.g., within approximately 10, 20, or 30 percent of the radius 108) may range from approximately 0° to approximately 80° and all subranges in between, such as approximately 20° to approximately 70°, approximately 30° to approximately 65°, approximately 40° to approximately 60°, and so forth. A circumferential axis 194 extends through the transition point 186 in the circumferential direction 40. The circumferential axis 194 is generally parallel to the shroud wall 74 and the hub wall 72. The constant turn region 180 has a swirl angle 196 (e.g. transition angle) with the circumferential axis 194 at the transition point 186. The swirl angle 192 and the transition angle 196 may be approximately equal. However, the angles 192, 196 may vary to a small extent, such as less than 1°, 2°, 3°, 4°, or 5°. Thus, the constant turn region 180 may have a slight curvature, but is substantially straight. In other embodiments, the constant turn region 180 may be arcuate, and the angles 192, 196 may differ by approximately 0° to approximately 80° and all subranges in between, such as approximately 20° to approximately 60°, approximately 30° to approximately 55°, approximately 40° to approximately 50°, and so forth.

The forced vortex region 182 has an arcuate shape 197. The forced vortex region 182 has a swirl angle 198 (e.g. transition angle) at the transition point 186. The transition angles 196, 198 may be approximately equal so that the radial profile 130 of the swirl vane 104 is relatively smooth. In other embodiments, the transition angles 196, 198 may be different from each other, such that swirl vane 104 is not smooth. The forced vortex region 182 has a swirl angle 200 at the hub wall 72. According to certain embodiments, the swirl angle 200 near the hub wall 72 (e.g., within approximately 10, 20, or 30 percent of the radius 108) may be acute and may be less than approximately 40°, or more specifically less than approximately 30°, or even more specifically less than approximately 20°. Accordingly, the swirl angle of the forced vortex region 182 decreases from the transition point 186 to the hub wall 72. As shown, the swirl angle 200 is less than the transition angle 198. As shown, the swirl angle of the swirl vane 104 generally decreases from the shroud wall 74 to the hub wall 72. In certain embodiments, the swirl angle may monotonically decrease from the shroud wall 74 to the hub wall 72. In other embodiments, the swirl angle may decrease along a region of the radial swirl profile 131 and increase along a different region of the radial swirl profile 131.

The radial swirl profile 127 of the upstream edge 124 (not shown) may be designed to have an approximately zero attack angle with the incoming air flow to minimize flow separations on both the pressure and suction sides 116, 118. The radial swirl profiles 127, 131 may be similar, or they may vary. The difference between the two radial swirl profiles 127 and 131 may form the radial swirl angle profile of the swirler 88. In such an embodiment, the shapes of the vane pressure side curve and suction side curve may gradually change along the length 110.

Figure 11:
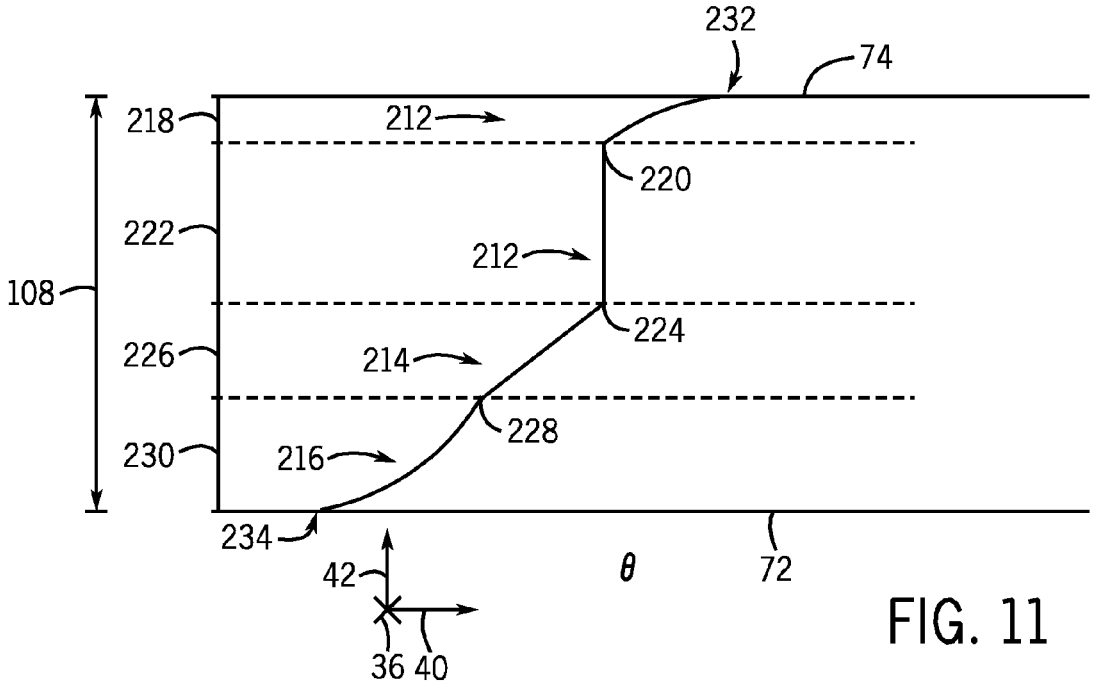
FIG. 11 is a graphical illustration of another embodiment of a radial swirl profile of a downstream edge of a swirl vane in accordance with aspects of the present techniques.

FIG. 11 is graphical illustration of another embodiment of the radial swirl profile 131 of downstream edge 128. The radial swirl profile 131 includes a free vortex arcuate region 210, a constant turn region 212, a linearly reduced region 214, and a forced vortex arcuate region 216. The free vortex region 210 extends a distance 218 from the shroud wall 74 to a first transition point 220. The constant turn region 212 extends a distance 222 from the first transition point 220 to a second transition point 224. The linearly reduced turn region 214 extends a distance 226 from the second transition point 224 to a third transition point 228. Finally, the forced vortex region 216 extends a distance 230 from the third transition point 228 to the hub wall 72. As illustrated, the swirl angle of the linearly reduced region 214 decreases towards the transition point 228. As shown, the distances 218, 222, 226, and 230 may vary in length. In particular, each of the distances 218, 222, 226, 230 may be approximately 5 to 95, approximately 15 to 85, or approximately 30 to 70 percent of the radius 108. The free vortex region 210 forms a swirl angle 232 at the shroud wall 74. Similarly, the forced vortex region 216 forms a swirl angle 234 at the hub wall 74. In the embodiment shown, the swirl angle increases along the length of the free vortex region 210, is constant along the constant turn region 212, decreases linearly along the linearly reduced turn region 214, and decreases along the length of the forced vortex region 216.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A system, comprising:

a fuel nozzle, comprising:

a center body configured to receive a first portion of air and to deliver the air to a combustion region; and a swirler configured to receive a second portion of air and to deliver the air to the combustion region, wherein the swirler comprises:

an outer shroud wall;

an inner hub wall comprising a fuel supply port; and a swirl vane with a radial swirl profile at a downstream edge of the swirl vane, wherein the radial swirl profile comprises a first region extending from the outer shroud wall to a transition point and a second region extending from the transition point to the inner hub wall, and the first region is substantially straight and the second region is arcuate, and wherein the swirl vane comprises a fuel injection port in fluid communication with the fuel supply port.

2. The system of claim 1, wherein the center body includes a diffusion swirler configured to induce a swirl to a subportion of the first portion of air.

3. The system of claim 1, wherein the radial swirl profile forms a first swirl angle at the outer shroud wall and the radial swirl profile forms a second swirl angle at the inner hub wall, and the first swirl angle is greater than the second swirl angle.

4. The system of claim 3, wherein the first swirl angle is between approximately 40 degrees and approximately 60 degrees.

5. The system of claim 3, wherein the second swirl angle is below approximately 20 degrees.

6. The system of claim 1, wherein the ratio of the first portion of air relative to the second portion of air is approximately 0.05 to approximately 0.25.

7. The system of claim 1, wherein the transition point is disposed proximate to a center of the radial swirl profile.

8. The system of claim 1, comprising a gas turbine comprising the combustor and the fuel nozzle.

9. The system of claim 1, wherein the center body comprises a plurality of swirler vanes configured to induce a swirl angle of the first portion of air exiting the center body at an angle between approximately 30 degrees and approximately 50 degrees.

10. A method, comprising:

directing a first portion of air through a center body of a fuel nozzle, wherein the first portion of air exits the center body with a first swirl angle near a hub wall of the fuel nozzle; and directing a second portion of air through a swirler of the fuel nozzle, wherein the second portion of air exits the swirler with a second swirl angle near a shroud wall of the fuel nozzle, the second portion of air exits the swirler with a third swirl angle near the hub wall of the fuel nozzle, and the second swirl angle is greater than the third swirl angle wherein the swirler has a swirl vane with a radial swirl profile at a downstream edge of the swirl vane, the radial swirl profile comprises a first region extending from the outer shroud wall to a transition point and a second region extending from the transition point to the inner hub wall, the first region is substantially straight and the second region is arcuate, wherein the inner hub wall comprises a fuel supply port, and the swirl vane comprises a fuel injection port in fluid communication with the fuel supply port.

11. The method of claim 10, wherein the ratio of the first portion of air relative to the second portion of air is approximately 0.05 to approximately 0.25.

12. The method of claim 10, comprising inducing the first swirl angle of the first portion of air exiting the center body at an angle between approximately 30degrees and approximately 50 degrees.

13. The method of claim 10, comprising inducing the second swirl angle of the second portion of air exiting the swirler near the shroud wall at an angle between approximately 40 degrees and approximately 60 degrees.

14. The method of claim 10, comprising inducing the third swirl angle of the second portion of air exiting the swirler near the hub wall at an angle below approximately 20 degrees.

15. A system, comprising:

a fuel nozzle swirler, comprising:

an outer shroud wall;

an inner hub wall comprising a fuel supply port; and a swirl vane with a radial swirl profile at a downstream edge of the swirl vane, wherein the radial swirl profile comprises a first region extending from the outer shroud wall to a transition point and a second region extending from the transition point to the inner hub wall, and the first region comprises a substantially constant swirl angle and the second region comprises a decreasing swirl angle toward the hub wall, and wherein the swirl vane comprises a fuel injection port in fluid communication with the fuel supply port.

16. The system of claim 15, wherein the radial swirl profile forms a first swirl angle of the first region at the outer shroud wall, the radial swirl profile forms a second swirl angle of the second region at the inner hub wall, and the first swirl angle is greater than the second swirl angle.

17. The system of claim 16, wherein the first swirl angle is between approximately 40 degrees and approximately 60 degrees.

18. The system of claim 16, wherein the second swirl angle is below approximately 20 degrees.

19. The system of claim 15, wherein the transition point is disposed proximate to a center of the radial swirl profile.

* * * * *